US010183199B1

(12) United States Patent
Warren

(10) Patent No.: US 10,183,199 B1
(45) Date of Patent: Jan. 22, 2019

(54) TUBULAR PROJECTILE DEVICE

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days.

(21) Appl. No.: 15/904,223

(22) Filed: Feb. 23, 2018

Related U.S. Application Data

(60) Provisional application No. 62/589,258, filed on Feb. 15, 2018, provisional application No. 62/592,044, filed on Nov. 29, 2017, provisional application No. 62/572,503, filed on Oct. 15, 2017.

(51) Int. Cl.
*A63B 43/00* (2006.01)

(52) U.S. Cl.
CPC ..... *A63B 43/002* (2013.01); *A63B 2243/007* (2013.01)

(58) Field of Classification Search
CPC ..... A63B 43/002; A63B 2243/007; A63B 37/0098; A63B 37/02; A63B 2225/01
USPC ..... D21/712
See application file for complete search history.

(56) References Cited

U.S. PATENT DOCUMENTS

D33,270 S 9/1900 Avery
2,011,760 A * 8/1935 Gallinant ..... A63B 41/08 273/DIG. 25
2,020,484 A 11/1935 Turner
3,225,488 A * 12/1965 Goldfarb ..... A63H 27/10 446/224
3,256,020 A 6/1966 Smith
3,688,538 A 9/1972 Hoyne
3,884,466 A * 5/1975 MacDonald ..... A63B 43/002 273/DIG. 20
D236,013 S 7/1975 Lombardi
3,957,270 A * 5/1976 Fekete ..... A63B 43/002 473/592
4,003,574 A * 1/1977 MacDonald ..... A63B 39/00 273/DIG. 20
D264,741 S * 6/1982 Patton ..... D21/712
4,923,196 A 5/1990 Rohring
5,000,451 A * 3/1991 MacDonald ..... A63B 43/00 273/DIG. 20
5,066,012 A * 11/1991 Stark ..... A63B 43/06 273/DIG. 20
5,123,645 A * 6/1992 MacDonald ..... A63B 43/002 273/DIG. 20

(Continued)

FOREIGN PATENT DOCUMENTS

CN 303012533 11/2014
EM 000188560-0001 8/2004

*Primary Examiner* — Steven Wong
(74) *Attorney, Agent, or Firm* — Carr & Ferrell LLP

(57) ABSTRACT

Tubular projectile devices are disclosed herein. An exemplary tubular projectile device includes a spheroid frame having a long axis and a short axis. Further, the exemplary tubular projectile device includes a tubular medial section coupled with the spheroid frame; a first bicone comprising an exterior first cone congruent with an interior first cone, the first bicone being terminal along the long axis of the spheroid frame and coupled with the spheroid frame; and a second bicone comprising an exterior second cone congruent with an interior second cone, the second bicone being terminal along the long axis of the spheroid frame and coupled with the spheroid frame. The exemplary tubular projectile device may be a football.

20 Claims, 21 Drawing Sheets

(56) References Cited

U.S. PATENT DOCUMENTS 5,269,514 A * 12/1993 Adler ..... A63B 43/002 273/DIG. 20
5,284,341 A 2/1994 Routzong et al.
5,316,293 A * 5/1994 Hamilton ..... A63B 43/00 446/400
5,458,329 A 10/1995 Bushman et al.
5,779,576 A 7/1998 Smith, III et al.
5,785,571 A * 7/1998 Camp ..... A63H 33/003 403/3
5,807,198 A * 9/1998 Grimm ..... A63B 65/00 473/613
6,010,419 A 1/2000 Rappaport et al.
6,042,494 A 3/2000 Rappaport et al.
D452,977 S 1/2002 Frisina et al.
D453,240 S 1/2002 Simon
D473,683 S 4/2003 Willinger
6,695,728 B1 2/2004 Eddins
6,726,580 B2 * 4/2004 Peterson ..... A63B 41/00 473/570
7,288,037 B2 10/2007 Myers
D562,419 S 2/2008 Crane et al.
D565,125 S 3/2008 Collier
7,740,551 B2 6/2010 Nurnberg et al.
D637,666 S * 5/2011 Erickson ..... D21/712
7,980,971 B2 * 7/2011 Martino ..... A63B 43/00 473/570
8,382,618 B2 * 2/2013 Lo ..... A63B 41/08 473/596
8,403,778 B2 * 3/2013 Wallach ..... A63B 43/002 473/596
8,460,135 B2 * 6/2013 Guenther ..... A63B 41/08 473/597
8,777,785 B2 * 7/2014 Martino ..... A63H 27/00 473/570
8,852,039 B2 * 10/2014 White ..... A63B 41/085 473/604
8,920,267 B2 12/2014 Gable
D755,450 S 5/2016 Setser
9,428,354 B1 8/2016 Makida et al.
9,782,636 B2 * 10/2017 Martino ..... A63H 27/14
2001/0039221 A1 11/2001 Schneider
2003/0027672 A1 2/2003 Leal et al.
2003/0100391 A1 5/2003 Kessler
2008/0039246 A1 2/2008 Martino
2008/0039250 A1 2/2008 Martino
2008/0090486 A1 4/2008 Zawitz
2009/0156092 A1 6/2009 Zawitz
2010/0069181 A1 3/2010 Lin
2011/0009218 A1 1/2011 Wallach et al.
2014/0235380 A1 8/2014 Martino
2016/0067556 A1 3/2016 Martino
2017/0008360 A1 1/2017 Kraus et al.

* cited by examiner

TUBULAR PROJECTILE DEVICE

CROSS-REFERENCE TO RELATED APPLICATIONS

The present patent application claims the benefit of U.S. Provisional Patent Application No. 62/592,044, filed on Nov. 29, 2017, of U.S. Provisional Patent Application No. 62/572,503, filed on Oct. 15, 2017, and of U.S. Provisional Patent Application No. 62/589,258, filed on Feb. 15, 2018. All of the aforementioned applications are hereby incorporated by reference for all purposes, including all references and appendices cited therein.

FIELD OF TECHNOLOGY

Embodiments of the present disclosure are directed to tubular projectile devices, and more particularly, to tubular projectile devices that resemble a football having a prolate (elongated) spheroid shape. In various embodiments, the tubular projectile device includes a medial section with a first bicone and a second bicone connected to the medial section by a frame. The first bicone and the second bicone altering flight dynamics of the tubular projectile device during flight.

SUMMARY

According to some embodiments, the present technology is directed to a tubular projectile device including a spheroid frame having a long axis and a short axis. In various embodiments, the spheroid frame includes a plurality of lateral support members along the long axis of the spheroid frame, a dorsal support member along the long axis of the spheroid frame, and a ventral support member along the long axis of the spheroid frame. In some embodiments, the tubular projectile device includes a tubular medial section coupled with the plurality of lateral support members, the dorsal support member, and the ventral support member. In various embodiments, the tubular projectile device includes a first bicone comprising an exterior first cone congruent with an interior first cone, the first bicone being terminal along the long axis of the spheroid frame and being coupled with the plurality of lateral support members, the dorsal support member, and the ventral support member. In some embodiments, the tubular projectile device also includes a second bicone comprising an exterior second cone congruent with an interior second cone, the second bicone being terminal along the long axis of the spheroid frame and being coupled with the plurality of lateral support members, the dorsal support member, and the ventral support member.

According to some embodiments, the present technology is directed to a football including a spheroid frame having a long axis and a short axis. In some embodiments, the spheroid frame includes a plurality of lateral support members along the long axis of the spheroid frame, a dorsal support member along the long axis of the spheroid frame, and a ventral support member along the long axis of the spheroid frame. In some embodiments, the tubular projectile device includes a tubular medial section coupled with the plurality of lateral support members, the dorsal support member, and the ventral support member. In various embodiments, the tubular projectile device includes a first bicone comprising an exterior first cone congruent with an interior first cone, the first bicone being anterior along the long axis of the spheroid frame and being coupled with the plurality of lateral support members, the dorsal support member, and the ventral support member. In some embodiments, the tubular projectile device includes an anterior airflow space between the first bicone and the tubular medial section, the anterior airflow space allowing air to flow into the tubular medial section during flight of the football. In various embodiments, the tubular projectile device includes a second bicone comprising an exterior second cone congruent with an interior second cone, the second bicone being posterior along the long axis of the spheroid frame and being coupled with the plurality of lateral support members, the dorsal support member, and the ventral support member. In some embodiments, the tubular projectile device includes a posterior airflow space between the second bicone and the tubular medial section, the posterior airflow space allowing air to flow out of the tubular medial section during flight of the football. In various embodiments, the anterior airflow space is smaller than the posterior airflow space resulting in improved flight dynamics of the football.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DESCRIPTION OF EXEMPLARY EMBODIMENTS

Embodiments of the present disclosure are directed to recreational devices. More particularly, tubular projectile devices, and more particularly but not by way of limitation, to tubular projectile devices with a prolate (elongated) spheroid shape that resembles a football.

While a prolate (elongated) spheroid shape for a tubular projectile device is contemplated, the projectile devices of the present technology can comprise any number of shapes as desired, such as cylindrical, ellipsoidal, and octahedral—just to name a few.

Footballs of the present disclosure include one or more bicones that alter aerodynamic attributes of the football during flight. A bicone or dicone is the three-dimensional surface of revolution of a rhombus around one of its axes of symmetry. Equivalently, a bicone is the surface created by joining two congruent right circular cones base-to-base. A bicone has advantages when used to alter the flight dynamics of projectile devices. For example, positioning of the bicones increases and/or decreases a distance traveled by the football when thrown.

These and other advantages of projectile devices of the present disclosure are described in greater detail herein with respect to the collective drawings.

Figure 1:
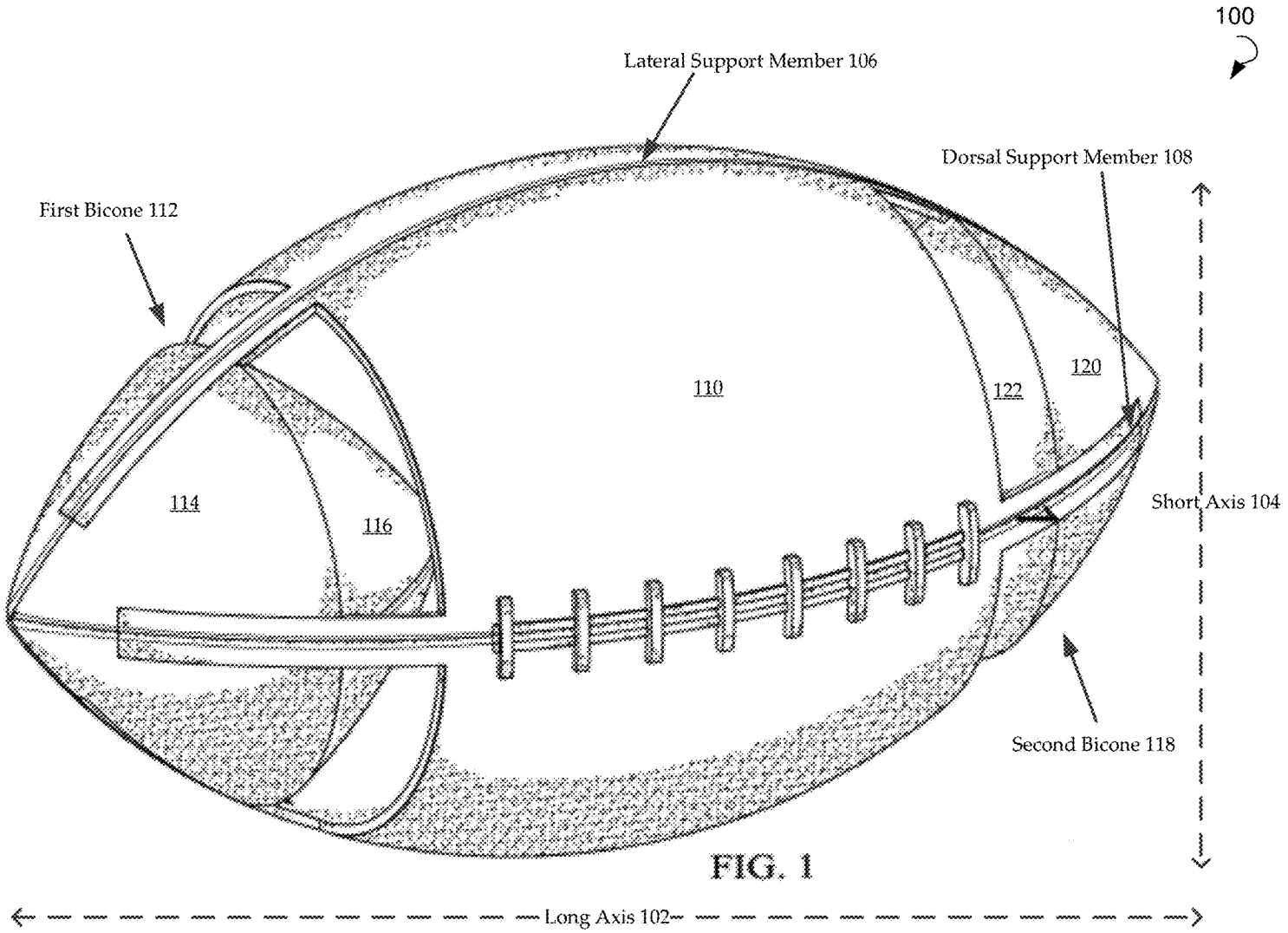
FIG. 1 is a perspective view of an exemplary tubular projectile device (e.g., a football), according to various embodiments of the present technology.

FIG. 1 is a perspective view of an exemplary tubular projectile device 100 (e.g., a football), according to various embodiments of the present technology. FIG. 1 illustrates the tubular projectile device 100 including a spheroid frame having a long axis 102 and a short axis 104. The spheroid frame includes a plurality of lateral support members (e.g., lateral support member 106) along the long axis 102 of the spheroid frame and a dorsal support member 108 along the long axis 102 of the spheroid frame. FIG. 1 further illustrates a tubular medial section 110 coupled with the lateral support member 106 and the dorsal support member 108. FIG. 1 also illustrates the exterior first cone 114 congruent with an interior first cone 116 with the first bicone 112 being terminal along the long axis 102 of the spheroid frame and being coupled with the lateral support member 106 and the dorsal support member 108. FIG. 1 also illustrates a second bicone 118 including the exterior second cone 120 congruent with the interior second cone 122, the second bicone 118 being terminal along the long axis 102 of the spheroid frame and being coupled with the lateral support member 106 and the dorsal support member 108.

In various embodiment, the tubular projectile device 100 comprises materials including Acrylonitrile Butadiene Styrene (ABS), ABS-like, ABS/polycarbonate, chlorinated polyvinyl chloride, thermoplastic polyurethane, liquid crystal polymer, Low-density polyethylene, linear low-density polyethylene, nylon, polybutylene terephthalate, polycarbonate, polycarbonate-like, polypropylene, polyvinyl chloride polypropylene like, Thermoplastic elastomers/thermoplastic rubbers, Thermoplastic vulcanizates (e.g., Santoprene™)—just to name a few.

In various embodiments, the first bicone 112 and the second bicone 118 are hollow. For example, a hollow bicone can decrease the weight of the tubular projectile device 100 to enhance the flight dynamics.

In some embodiments, the first bicone 112 and the second bicone 118 are solid. For example, a solid bicone can increase the weight of the tubular projectile device 100 to enhance resistance when throwing the tubular projectile device 100. In some embodiments one bicone is hallow and one bicone is solid changing the flight dynamics of the tubular projectile device 100.

In various embodiments, the first bicone 112 and the second bicone 118 include a fitness tracking device to track flight metrics of the tubular projectile device 100. For example, the fitness tracker may be included inside the first bicone 112 or the second bicone 118 to track the flight dynamics of the tubular projectile device 100. In some instances, when the tubular projectile device 100 is thrown, the fitness tracking device tracks distance traveled, speed, flight path, and the like.

In various embodiments, the fitness tracking device to track flight metrics of the tubular projectile device 100 may communicatively couple via a public or private network. Suitable networks (e.g., network 130) may include or interface with any one or more of, for instance, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, Digital Data Service (DDS) connection, DSL (Digital Subscriber Line) connection, an Ethernet connection, an ISDN (Integrated Services Digital Network) line, a dial-up port such as a V.90, V.34 or V.34bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), CDMA (Code Division Multiple Access) or TDMA (Time Division Multiple Access), cellular phone networks, GPS (Global Positioning System), CDPD (cellular digital packet data), RIM (Research in Motion, Limited) duplex paging network, Bluetooth radio, or an IEEE 802.11-based radio frequency network. The network 130 can further include or interface with any one or more of an RS-232 serial connection, an IEEE-1394 (Firewire) connection, a Fiber Channel connection, an IrDA (infrared) port, a SCSI (Small Computer Systems Interface) connection, a USB (Universal Serial Bus) connection or other wired or wireless, digital or analog interface or connection, mesh or Digi® networking.

Figure 2:
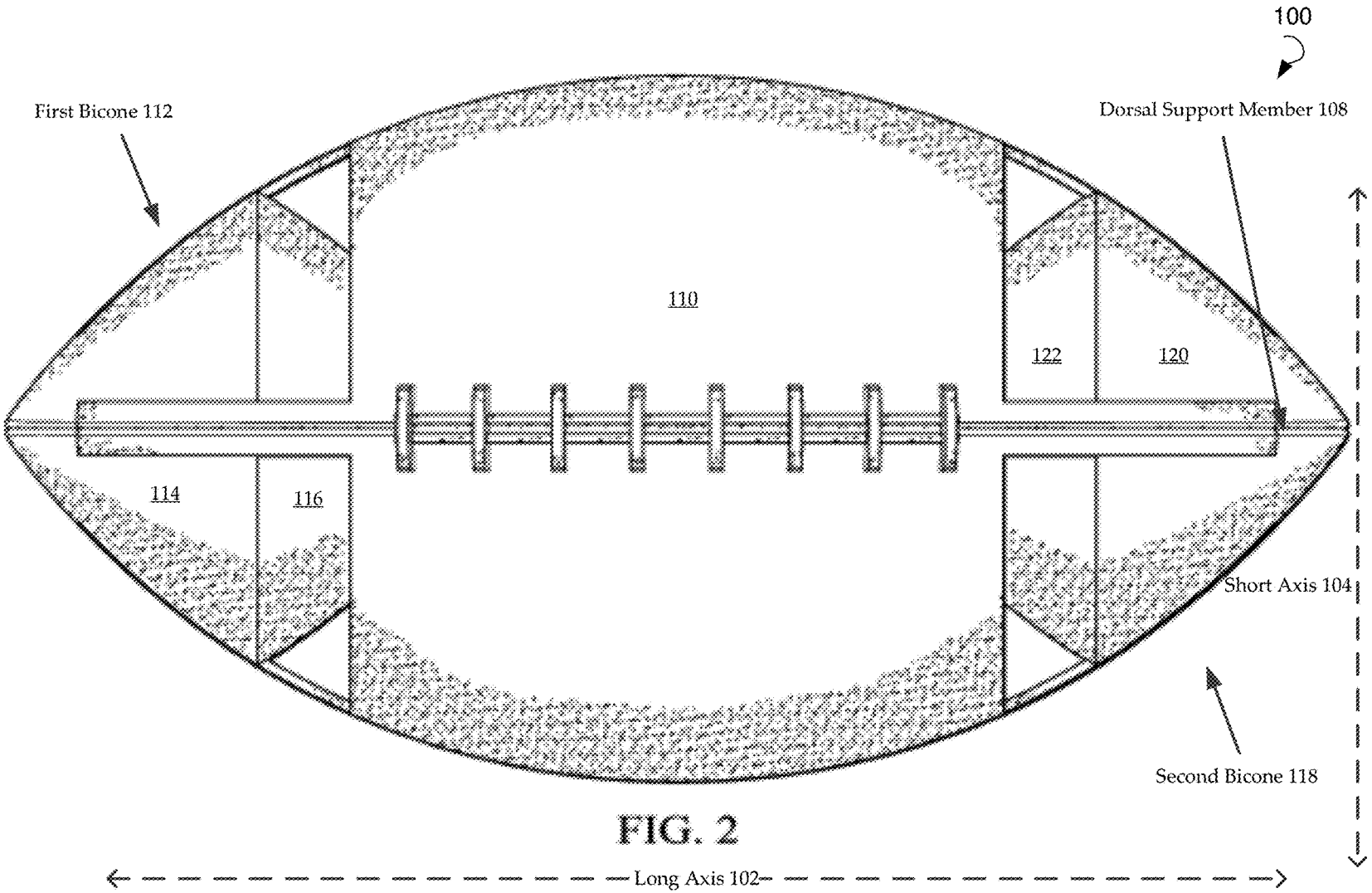
FIG. 2 is a dorsal view of an exemplary tubular projectile device illustrating a plurality of laces coupled to a dorsal support member, according to various embodiments of the present technology.

FIG. 2 is a dorsal view of the tubular projectile device 100 illustrating a plurality of laces coupled to the dorsal support member 108, according to various embodiments of the present technology. FIG. 2 illustrates the tubular projectile device 100 including a spheroid frame having the long axis 102 and the short axis 104. The spheroid frame includes the dorsal support member 108 along the long axis 102 of the spheroid frame. FIG. 2 further illustrates the tubular medial section 110 coupled with the dorsal support member 108. FIG. 2 also illustrates the first bicone 112 including the exterior first cone 114 congruent with the interior first cone 116 with the first bicone 112 being terminal along the long axis 102 of the spheroid frame and being coupled with the dorsal support member 108. FIG. 2 also illustrates the second bicone 118 including the exterior second cone 120 congruent with the interior second cone 122, the second bicone 118 being terminal along the long axis 102 of the spheroid frame and being coupled with the dorsal support member 108.

Figure 3:
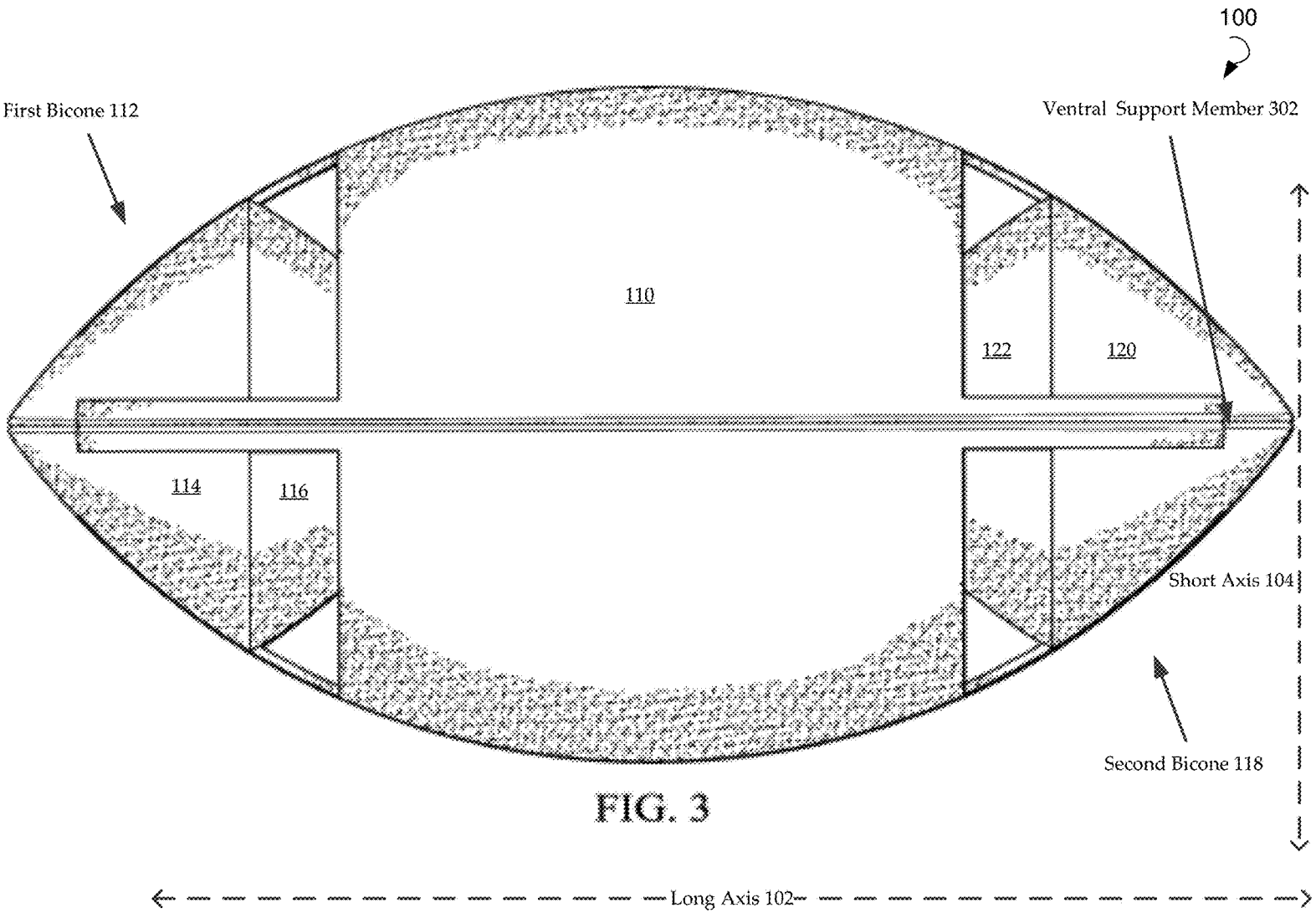
FIG. 3 is a ventral view of an exemplary tubular projectile device illustrating a ventral support member, according to various embodiments of the present technology.

FIG. 3 is a ventral view of the tubular projectile device 100 illustrating a ventral support member 302, according to various embodiments of the present technology. FIG. 3 illustrates the tubular projectile device 100 including a spheroid frame having the long axis 102 and the short axis 104. The spheroid frame includes a ventral support member 302 along the long axis 102 of the spheroid frame. FIG. 3 further illustrates the tubular medial section 110 coupled with the ventral support member 302. FIG. 3 also illustrates the first bicone 112 including the exterior first cone 114 congruent with the interior first cone 116 with the first bicone 112 being terminal along the long axis 102 of the spheroid frame and being coupled with the ventral support member 302. FIG. 3 also illustrates the second bicone 118 including the exterior second cone 120 congruent with the interior second cone 122, the second bicone 118 being terminal along the long axis 102 of the spheroid frame and being coupled with the ventral support member 302.

In some embodiments, the spheroid frame, including the plurality of lateral support members (e.g., lateral support member 106), the dorsal support member (e.g., dorsal support member 108), and the ventral support member (e.g., ventral support member 302), is a solid-state weld. For example, solid state welding is a welding process, in which two work pieces are joined under a pressure providing an intimate contact between them and at a temperature essentially below the melting point of the parent material. Bonding of the materials is a result of diffusion of their interface atoms. Thus, the solid-state weld enhances the durability of the spheroid frame for the tubular projectile device 100.

In various embodiments, the spheroid frame comprises polyethylene. Polyethylene is a thermoplastic polymer with variable crystalline structure and an extremely large range of applications depending on the particular type. In some embodiments the spheroid frame includes High Density Polyethylene (HDPE) that is a strong, high density, moderately stiff plastic with a highly crystalline structure. In various embodiments, the spheroid frame includes Ultrahigh Molecular Weight Polyethylene (UHMW) that is an extremely dense version of polyethylene with molecular weights typically an order of magnitude greater than HDPE. Different configurations of polyethylene may enhance the spheroid frame for the tubular projectile device 100.

Figure 4:
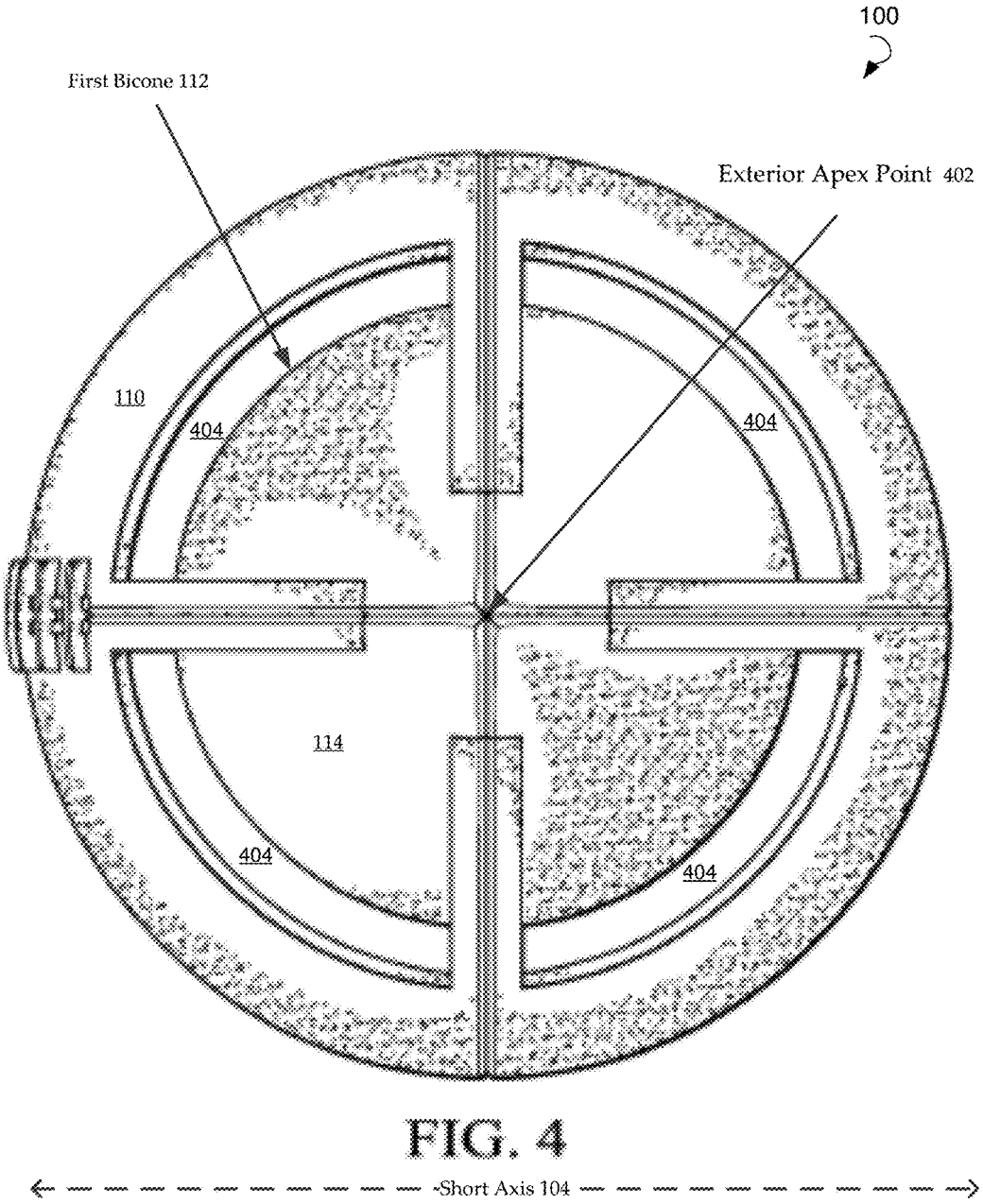
FIG. 4 is an end view of an exemplary tubular projectile device illustrating a first bicone with the plurality of laces oriented to left side of a viewer, according to various embodiments of the present technology.

FIG. 4 is an end view of the tubular projectile device 100 illustrating the first bicone 112 with the plurality of laces oriented to left side of a viewer, according to various embodiments of the present technology. FIG. 4 illustrates the tubular projectile device 100 including a first opening (not shown) from a first exterior apex point 402 of the exterior first cone 114 to an interior apex point (not shown) of the interior first cone (not shown) with the first opening allowing airflow through the first bicone 112 during flight of the tubular projectile device 100 to improve aerodynamics of the tubular projectile device 100.

In various embodiments, the tubular projectile device 100 includes an anterior airflow space 404 between the first bicone 112 and the tubular medial section 110, the anterior airflow space 404 allowing air to flow into the tubular medial section 110 during flight of the tubular projectile device 100.

Figure 5:
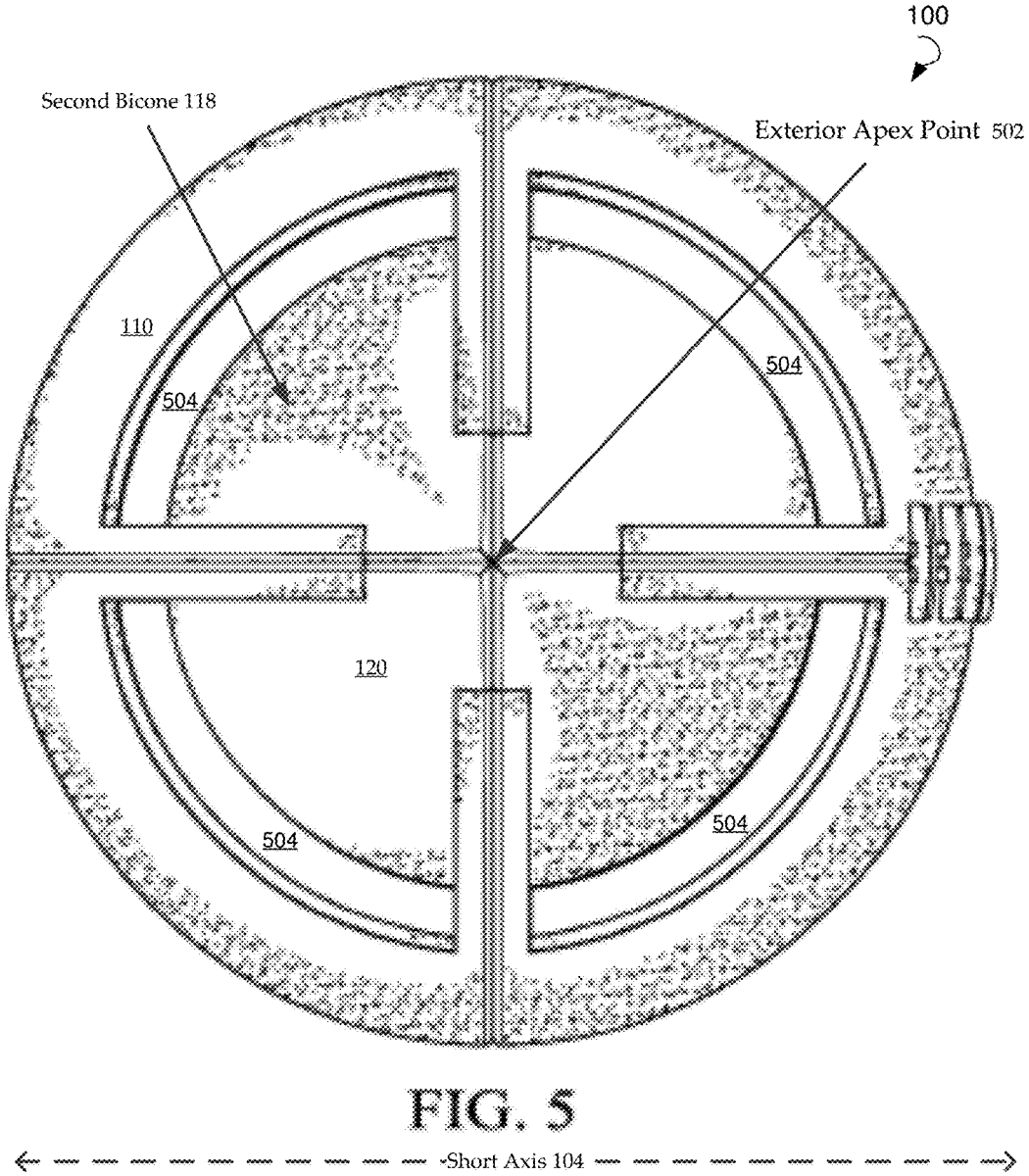
FIG. 5 is another end view of an exemplary tubular projectile device illustrating a second bicone with the plurality of laces oriented to right side of a viewer, according to various embodiments of the present technology.

FIG. 5 is another end view of the tubular projectile device 100 illustrating the second bicone 118 with the plurality of laces oriented to right side of a viewer, according to various embodiments of the present technology. FIG. 5 illustrates the tubular projectile device 100 including a second opening (not shown) from a second exterior apex point 502 of the exterior second cone 120 to an interior apex point (not shown) of the interior second cone 122, the second opening allowing airflow through the second bicone 118 during flight of the tubular projectile device 100 to improve aerodynamics of the tubular projectile device 100 during flight.

In various embodiments, the tubular projectile device 100 includes a posterior airflow space 504 between the second bicone 118 and the tubular medial section 110, the posterior airflow space 504 allowing air to flow out of the tubular medial section 110 during flight of the tubular projectile device 100.

In various embodiments, the anterior airflow space 404 of FIG. 4 is the same size as the posterior airflow space 504 resulting in the tubular projectile device 100 being capable of bidirectional flight.

In some embodiments, the anterior airflow space 404 of FIG. 4 is smaller than the posterior airflow space 504 of FIG. 5 resulting in improved flight dynamics of the tubular projectile device 100. The alteration of airflow space (e.g., the anterior airflow space 404 and posterior airflow space 504) enhances the flight dynamics of the tubular projectile device 100. For example, the lift dynamics during flight may be enhanced.

Figure 6:
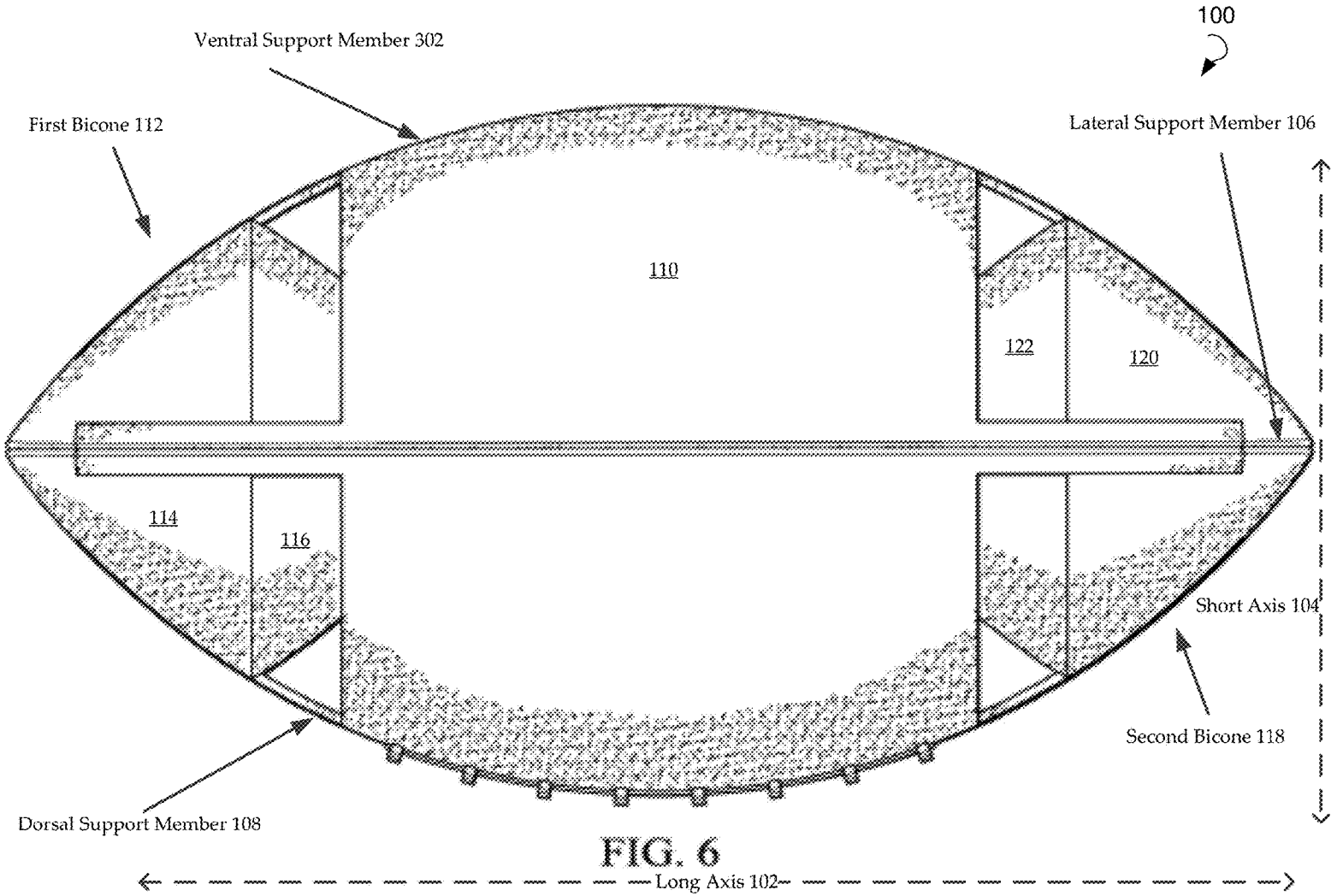
FIG. 6 is a lateral view of an exemplary tubular projectile device illustrating a lateral support member with the plurality of laces oriented to the bottom, according to various embodiments of the present technology.

FIG. 6 is a lateral view of the tubular projectile device 100 illustrating the lateral support member 106 with the plurality of laces oriented to the bottom, according to various embodiments of the present technology. FIG. 6 illustrates the tubular projectile device 100 including a spheroid frame having the long axis 102 and the short axis 104. The spheroid frame includes a plurality of lateral support members (e.g., lateral support member 106) along the long axis 102 of the spheroid frame, the dorsal support member 108 along the long axis 102 of the spheroid frame, and a ventral support member 302 along the long axis 102 of the spheroid frame. FIG. 6 further illustrates the tubular medial section 110 coupled with the ventral support member 302, the lateral support member 106, and the dorsal support member 108. FIG. 6 also illustrates the first bicone 112 including the exterior first cone 114 congruent with the interior first cone 116 with the first bicone 112 being terminal along the long axis 102 of the spheroid frame and being coupled with the ventral support member 302, the lateral support member 106, and the dorsal support member 108. FIG. 6 also illustrates the second bicone 118 including the exterior second cone 120 congruent with the interior second cone 122, the second bicone 118 being terminal along the long axis 102 of the spheroid frame and being coupled with the ventral support member 302, the lateral support member 106, and the dorsal support member 108.

Figure 7:
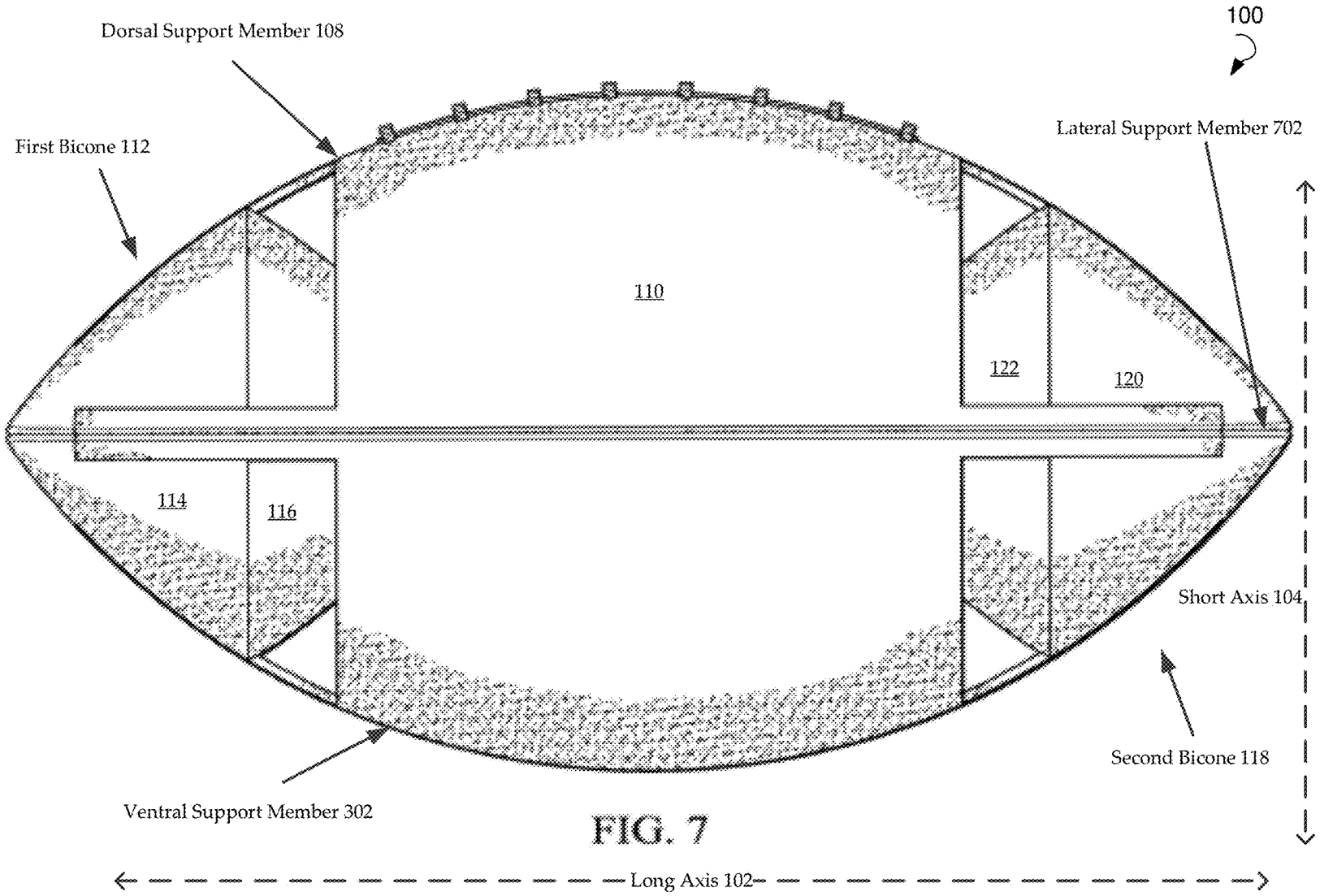
FIG. 7 is lateral view of an exemplary tubular projectile device illustrating a lateral support member with the plurality of laces oriented to the top, according to various embodiments of the present technology.

FIG. 7 is lateral view of the tubular projectile device 100 illustrating a lateral support member 702 with the plurality of laces oriented to the top, according to various embodiments of the present technology. FIG. 7 illustrates the tubular projectile device 100 including a spheroid frame having the long axis 102 and the short axis 104. The spheroid frame includes a plurality of lateral support members (e.g., support member 702) along the long axis 102 of the spheroid frame, the dorsal support member 108 along the long axis 102 of the spheroid frame, and a ventral support member 302 along the long axis 102 of the spheroid frame. FIG. 7 further illustrates the tubular medial section 110 coupled with the ventral support member 302, the lateral support member 702, and the dorsal support member 108. FIG. 7 also illustrates the first bicone 112 including the exterior first cone 114 congruent with the interior first cone 116 with the first bicone 112 being terminal along the long axis 102 of the spheroid frame and being coupled with the ventral support member 302, the lateral support member 702, and the dorsal support member 108. FIG. 7 also illustrates the second bicone 118 including the exterior second cone 120 congruent with the interior second cone 122, the second bicone 118 being terminal along the long axis 102 of the spheroid frame and being coupled with the ventral support member 302, the lateral support member 702, and the dorsal support member 108.

Figure 8:
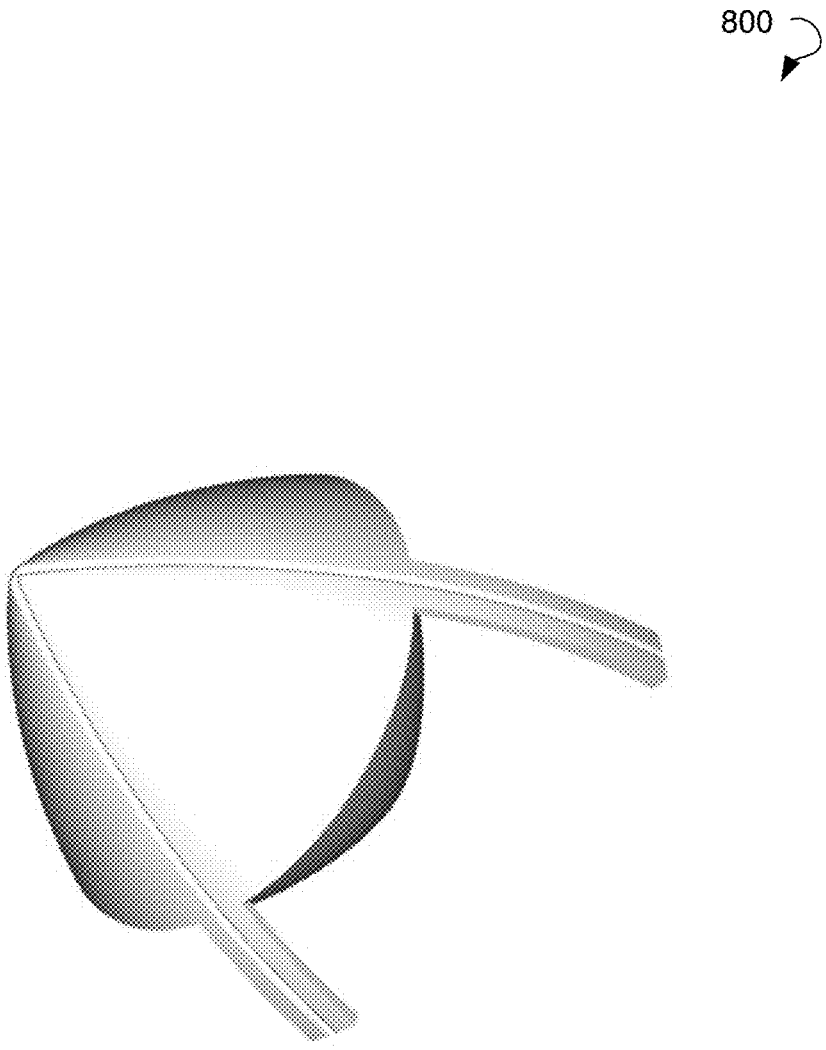
FIG. 8 is a front perspective view of a bicone being coupled with the plurality of lateral support members, the dorsal support member, and the ventral support member according to various embodiments of the present technology.

FIG. 8 is a front perspective view of example bicone 800 (e.g., first bicone 112 and second bicone 118) being coupled with the plurality of lateral support members, the dorsal support member, and the ventral support member according to various embodiments of the present technology.

Figure 9:
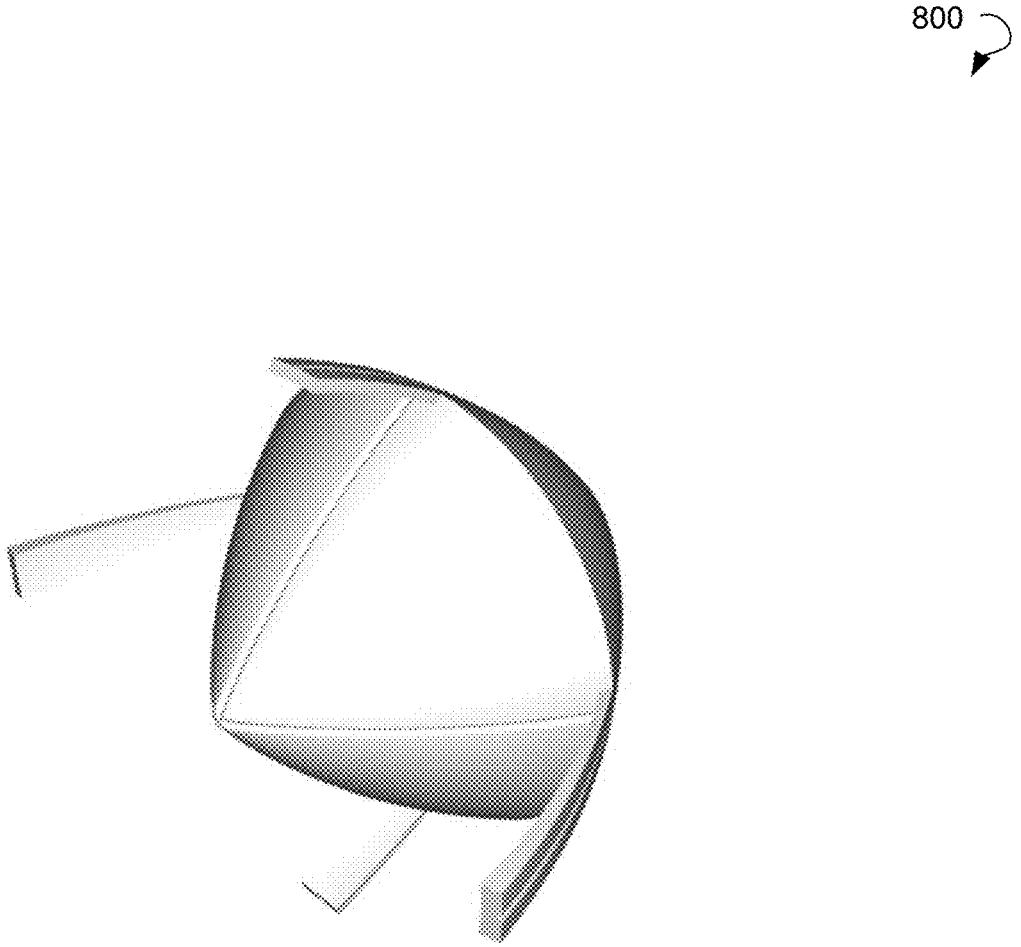
FIG. 9 back perspective view of a bicone being coupled with the plurality of lateral support members, the dorsal support member, and the ventral support member according to various embodiments of the present technology.

FIG. 9 back perspective view of the example bicone 800 being coupled with the plurality of lateral support members, the dorsal support member, and the ventral support member according to various embodiments of the present technology.

Figure 10:
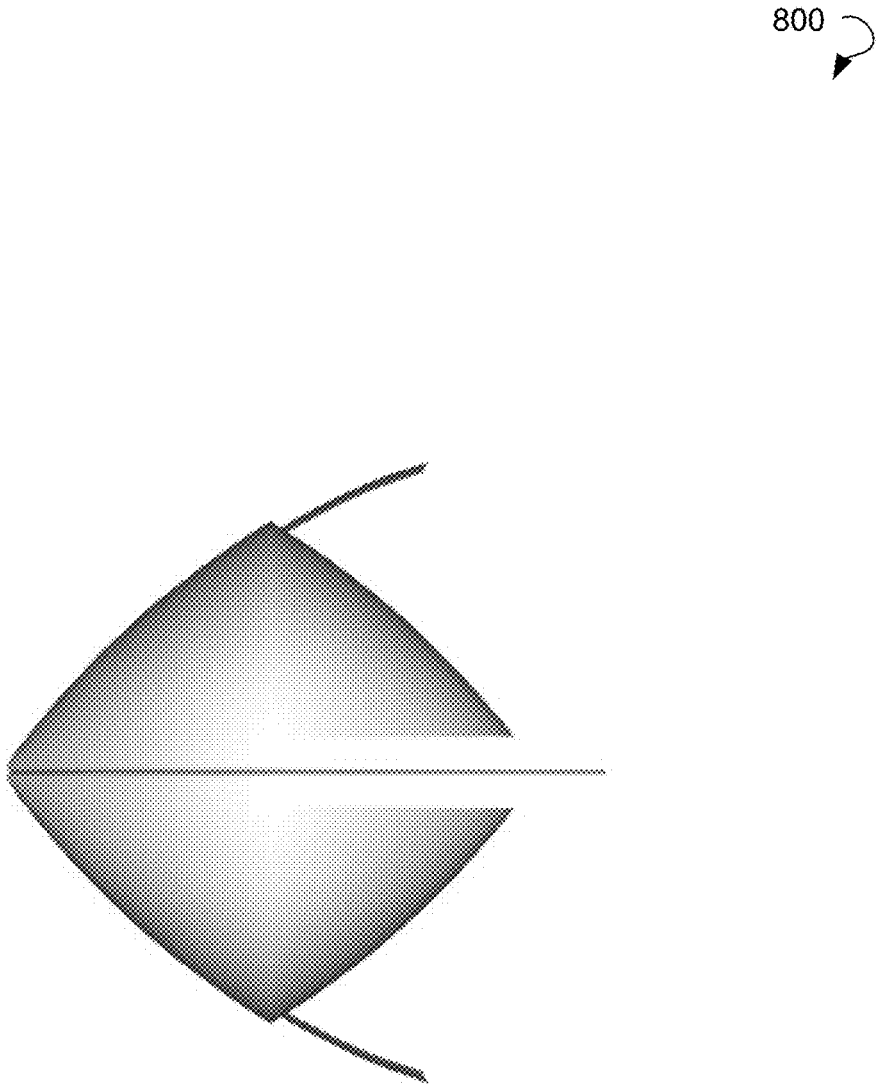
FIG. 10 side view of a bicone being coupled with the plurality of lateral support members, the dorsal support member, and the ventral support member according to various embodiments of the present technology.

FIG. 10 side view of the example bicone 800 being coupled with the plurality of lateral support members, the dorsal support member, and the ventral support member according to various embodiments of the present technology.

Figure 11:
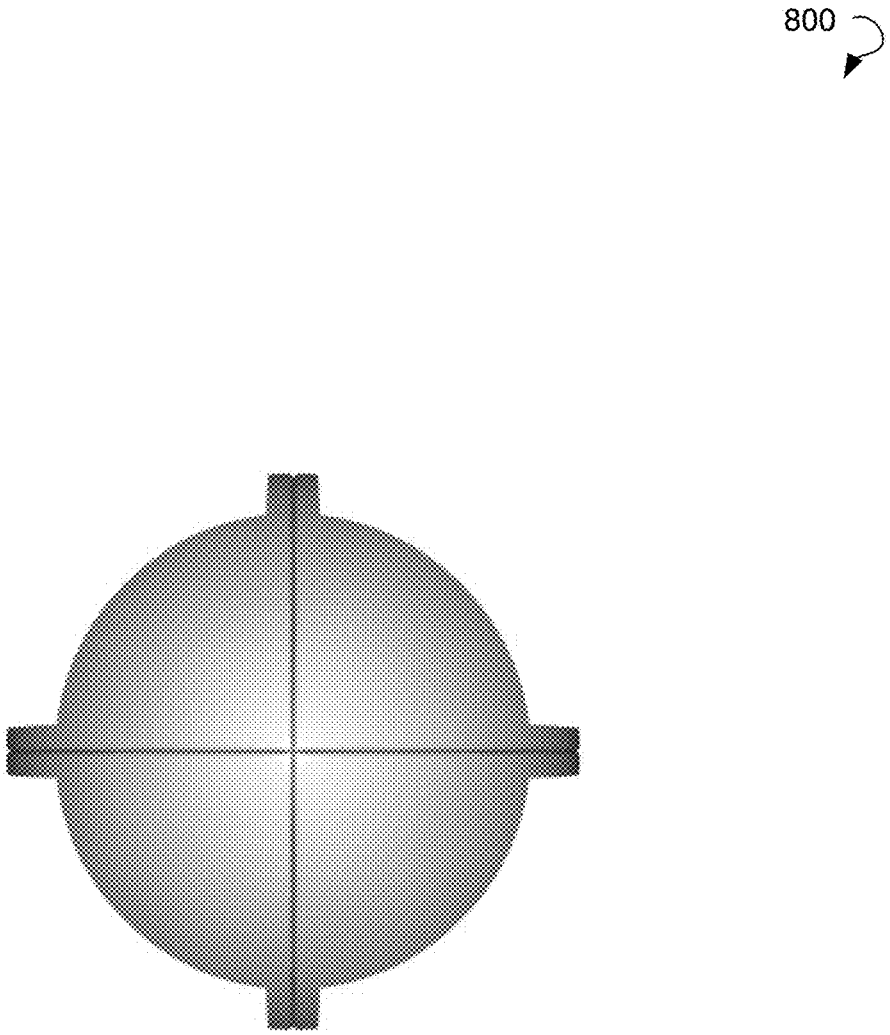
FIG. 11 is a front view of a bicone being coupled with the plurality of lateral support members, the dorsal support member, and the ventral support member according to various embodiments of the present technology.

FIG. 11 is a front view of the example bicone 800 being coupled with the plurality of lateral support members, the dorsal support member, and the ventral support member according to various embodiments of the present technology.

Figure 12:
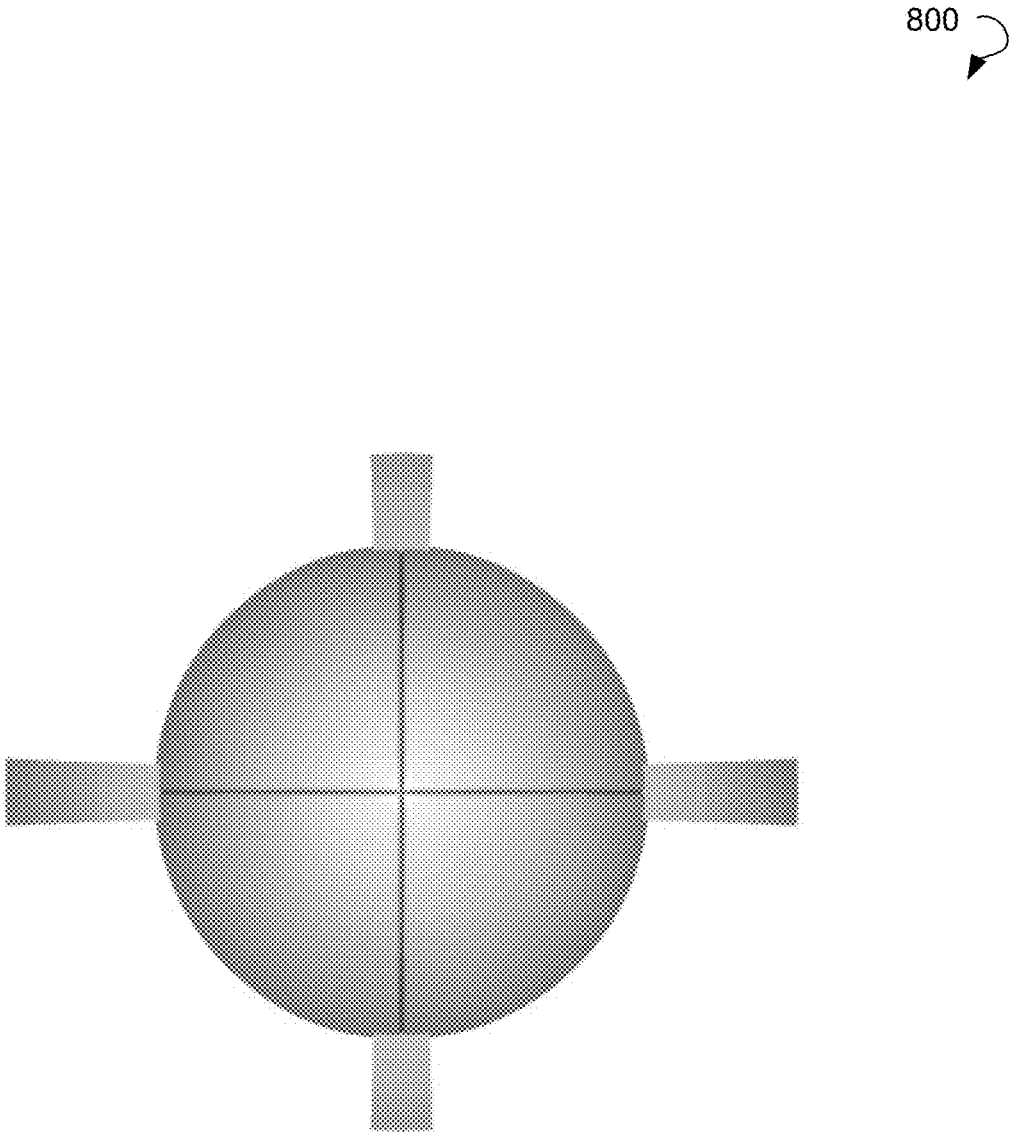
FIG. 12 is a back view of a bicone being coupled with the plurality of lateral support members, the dorsal support member, and the ventral support member according to various embodiments of the present technology.

FIG. 12 is a back view of the example bicone 800 being coupled with the plurality of lateral support members, the dorsal support member, and the ventral support member according to various embodiments of the present technology.

Figure 13:
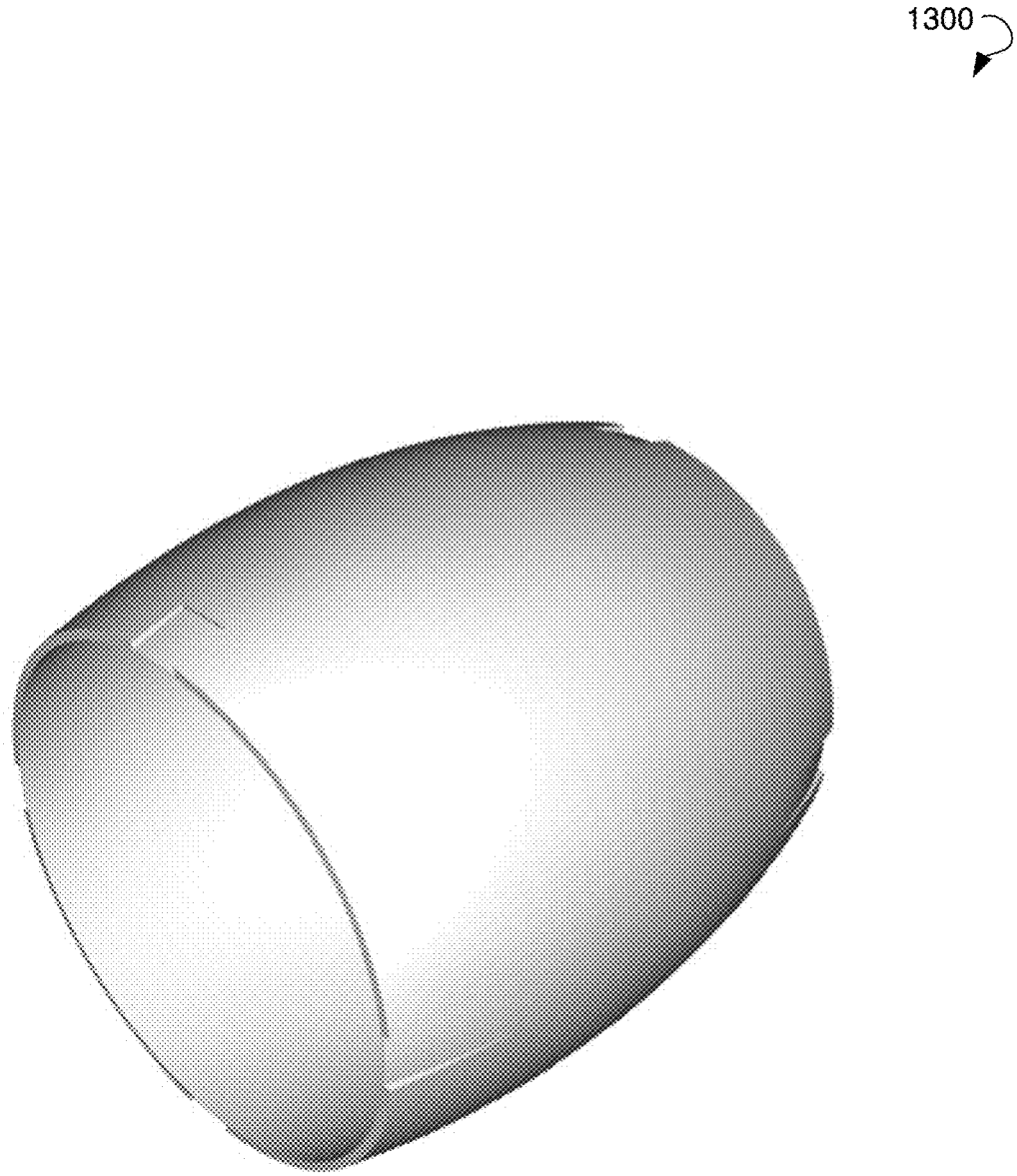
FIG. 13 is a perspective view of a tubular medial section according to various embodiments of the present technology.

FIG. 13 is a perspective view of an example tubular medial section 1300 according to various embodiments of the present technology.

In various embodiments the example tubular medial section 1300 is a straight tubular shape. For example, a tubular shape may enhance the flight dynamics of the tubular projectile device 100.

In some embodiments the tubular medial section is a curved tubular shape. For example, a curved tubular shape may enhance the flight dynamics of the tubular projectile device 100.

Figure 14:
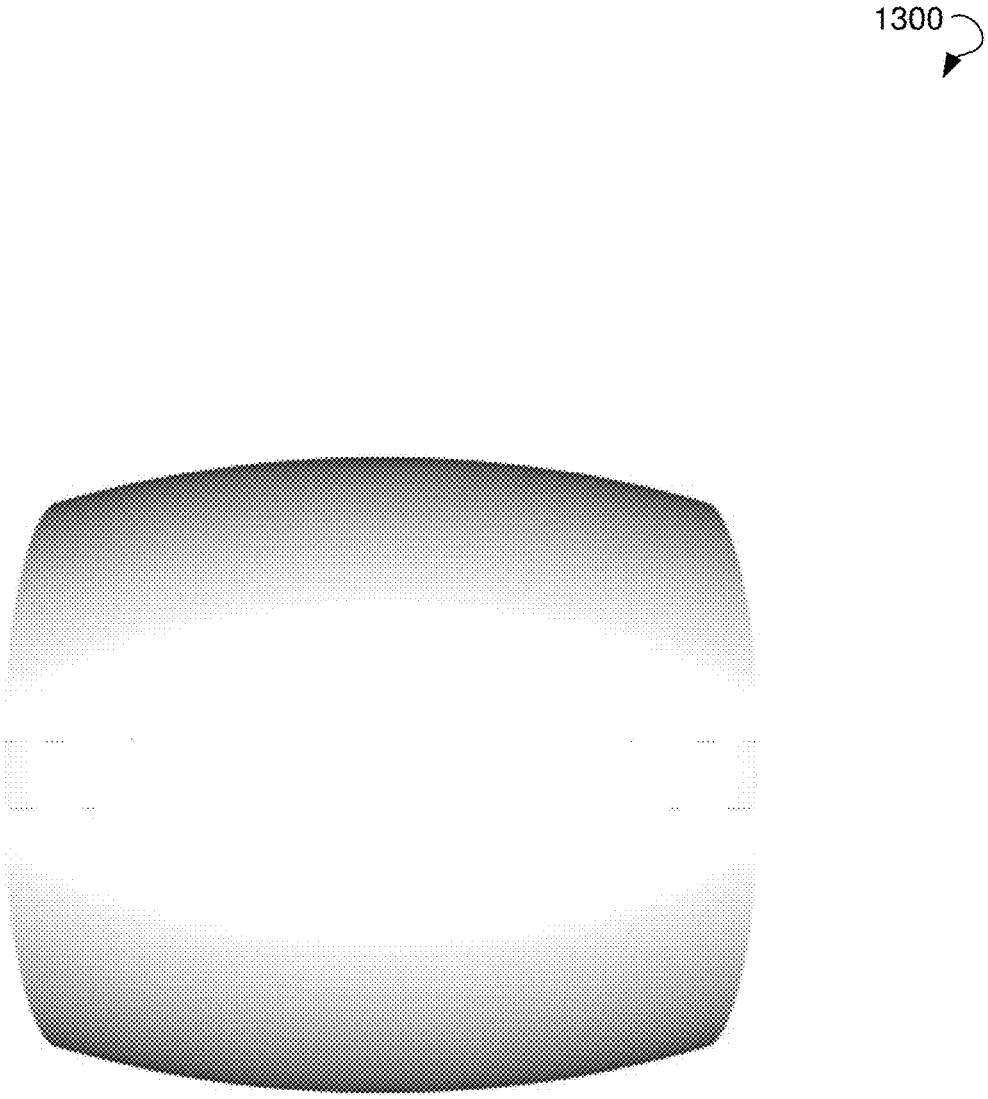
FIG. 14 is a side view of a tubular medial section according to various embodiments of the present technology.

FIG. 14 is a side view of the example tubular medial section 1300 according to various embodiments of the present technology.

Figure 15:
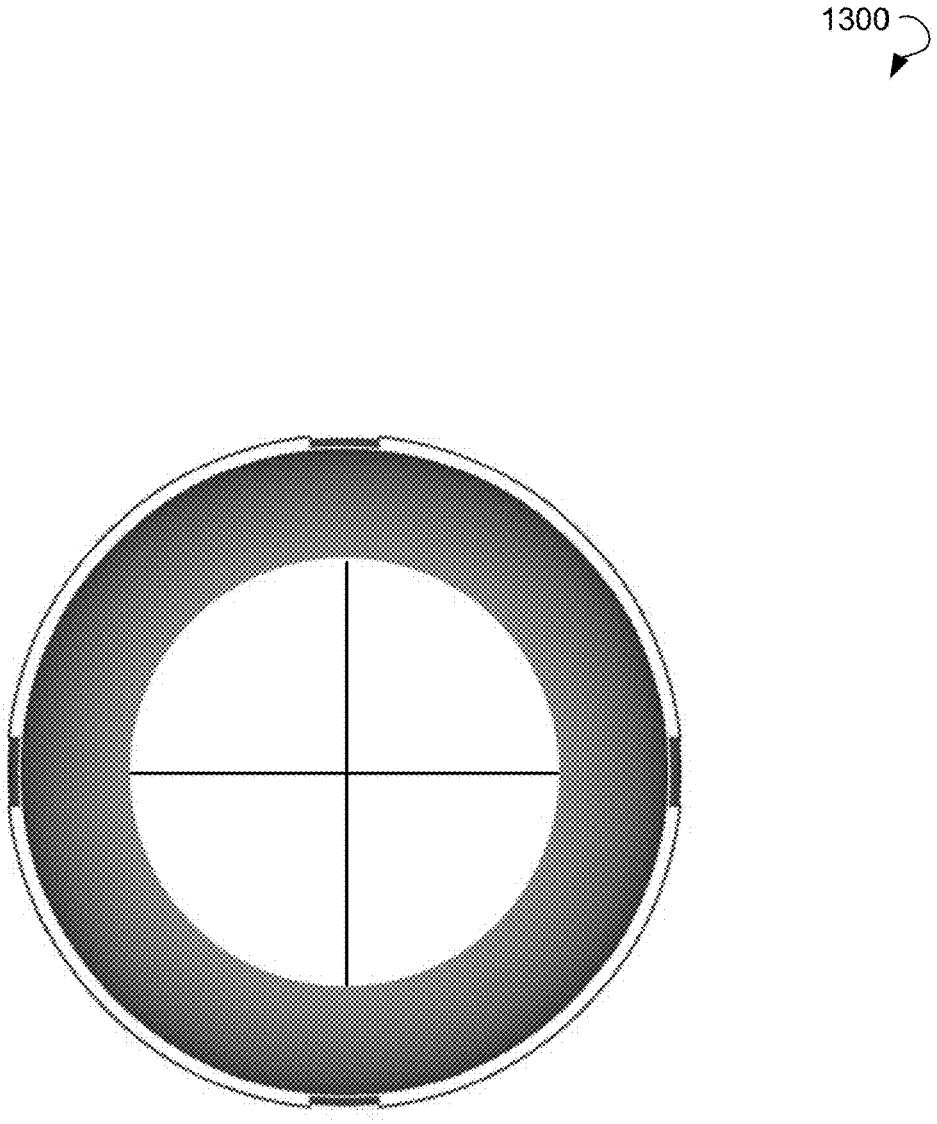
FIG. 15 is an end view of a tubular medial section according to various embodiments of the present technology.

FIG. 15 is an end view of the example tubular medial section 1300 according to various embodiments of the present technology. In some embodiments, air flows through the example tubular medial section 1300 during flight of the tubular projectile device 100 enhancing flight dynamics.

In some embodiments, the spheroid frame further comprises a cross shaped support member, the cross shaped support member being perpendicular support members located in an interior of the tubular medial section (not shown). In some instances, the cross shaped support member is centrally positioned along a long axis of the tubular projectile device 100. In various instances, the cross shaped support member is coupled with a central support member along a long axis of the tubular projectile device 100. In various embodiments, the central support member is coupled with the first bicone and the second bicone. In some instances, a vertical support member is centrally located in an interior of the tubular medial section and is not connected to the first or the second bicone making the first and the second bicone appear to be "floating".

In some embodiments, the spheroid frame further comprises additional support members in an interior of the tubular medial section (not shown). In various embodiments, the spheroid frame includes a spike oriented along the long axis of the spheroid frame that is 90 degrees from other pertinent axis. In some embodiments, the spheroid frame includes a floating symmetrical spike along the long axis of the spheroid frame. In some instances, the spheroid frame includes a somewhat symmetrical spike along the long axis of the spheroid frame. In various embodiments, the spike may be connected directly to the tubular medial section.

Figure 16:
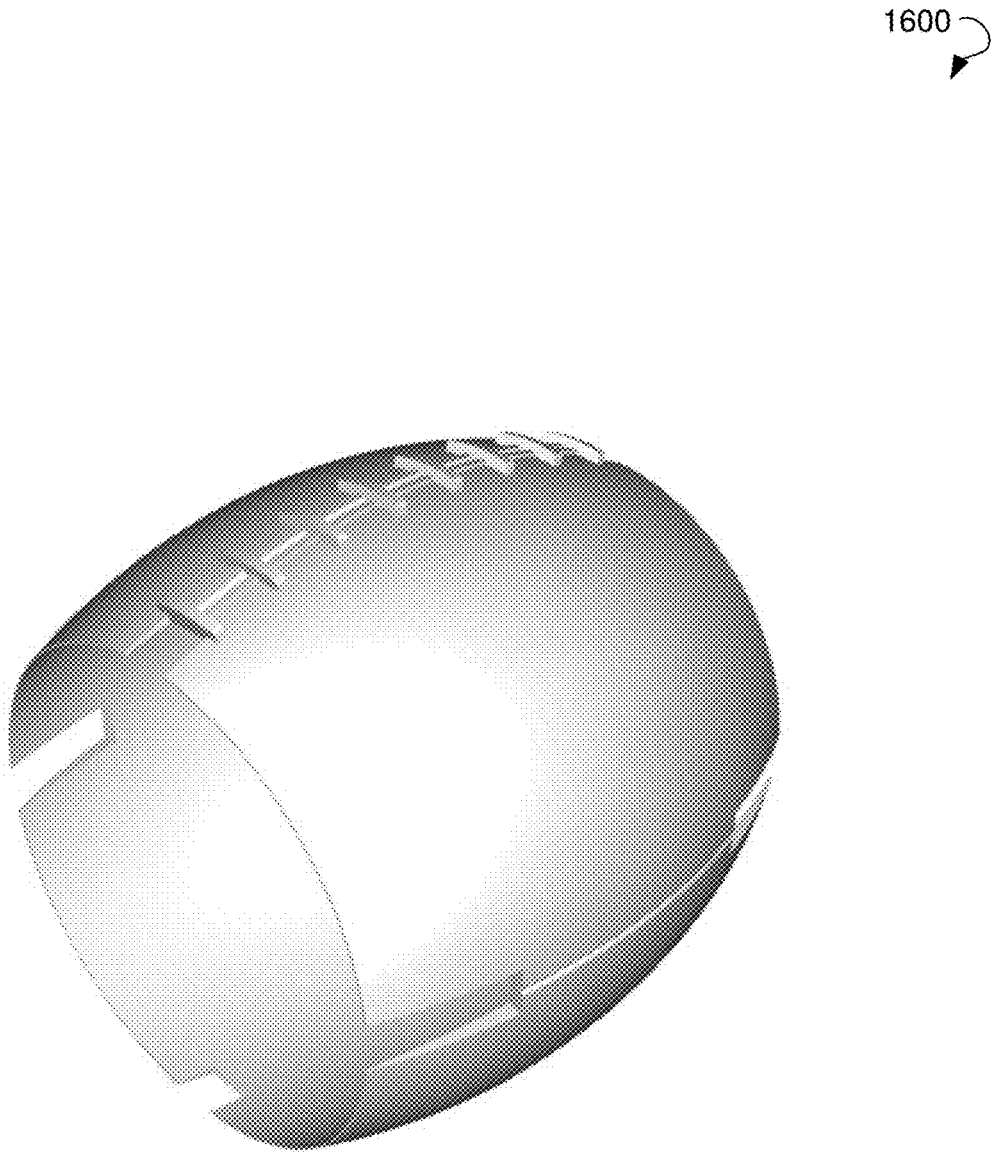
FIG. 16 is a top perspective view of a cover with laces visible according to various embodiments of the present technology.

FIG. 16 is a top perspective view of a cover 1600 with laces visible according to various embodiments of the present technology. In various embodiments, the cover 1600 surrounds the tubular medial section (e.g., tubular medial section 1300).

In various embodiments the tubular projectile device 100 includes a padding layer between the tubular medial section (e.g., tubular medial section 1300) and the cover (e.g., cover 1600) (not shown).

In some embodiments the tubular projectile device 100 includes the cover 1600 on top of the padding layer surrounding the tubular medial section.

In various embodiments the tubular projectile device includes a plurality of laces coupled to the cover 1600.

Figure 17:
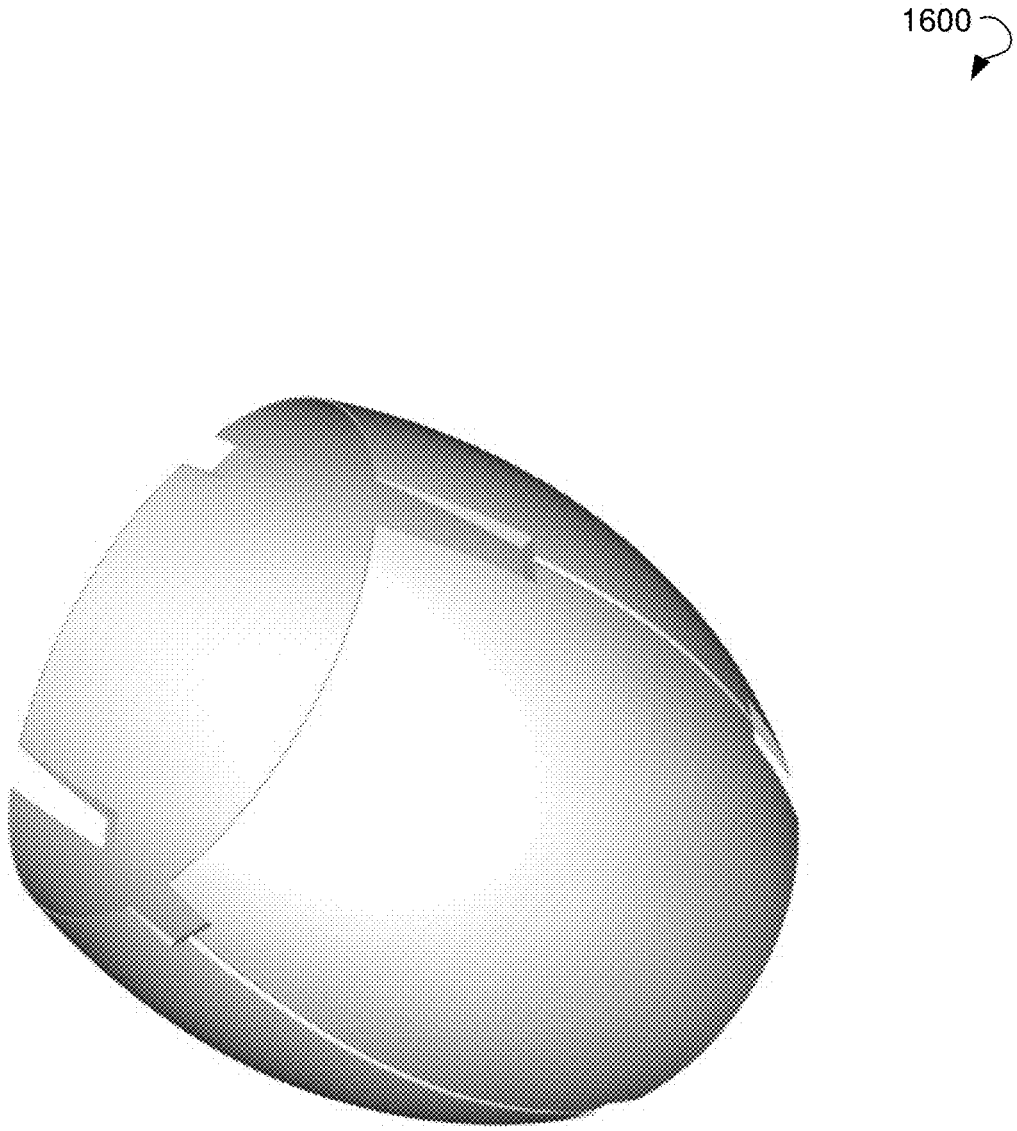
FIG. 17 is a bottom perspective view of a cover according to various embodiments of the present technology.

FIG. 17 is a bottom perspective view of the cover 1600 according to various embodiments of the present technology.

Figure 18:
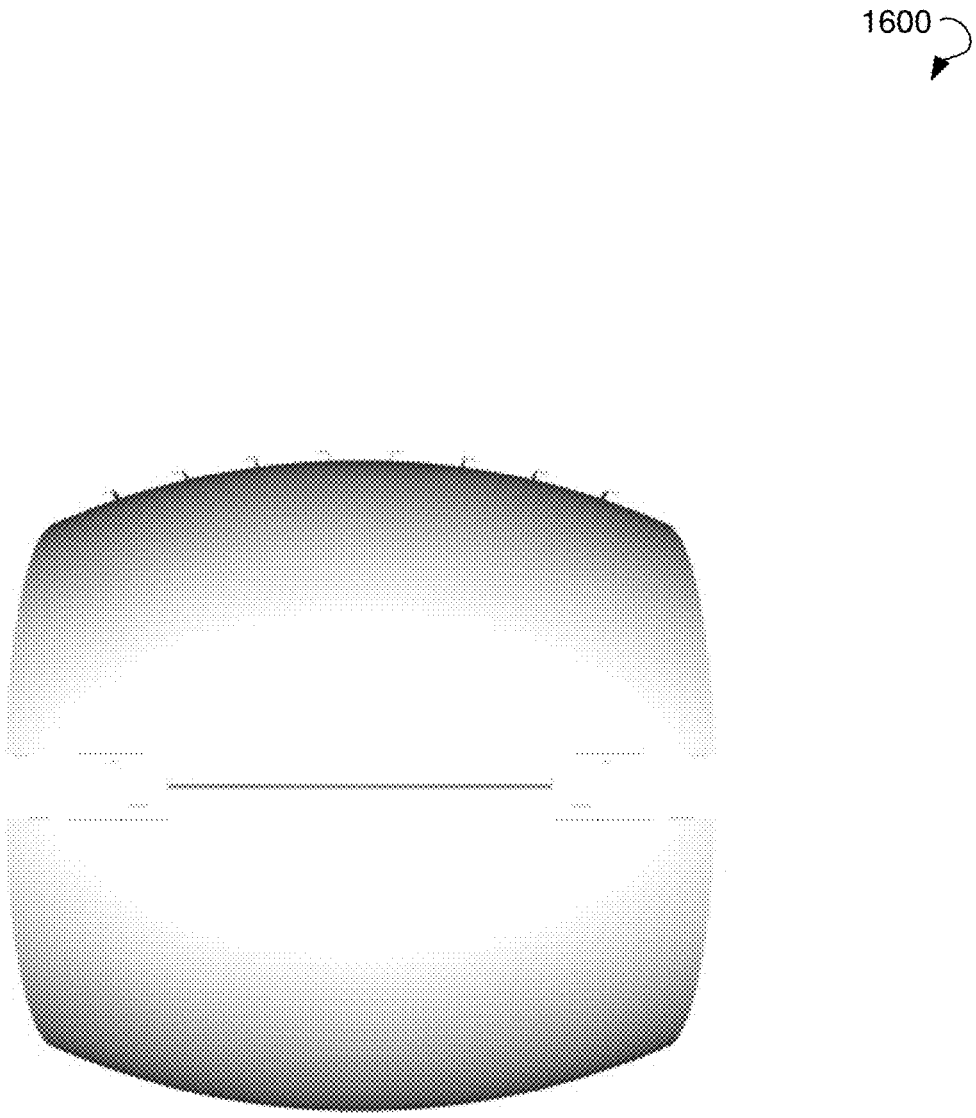
FIG. 18 side view of a cover with laces visible according to various embodiments of the present technology.

FIG. 18 side view of the cover 1600 with laces visible according to various embodiments of the present technology.

Figure 19:
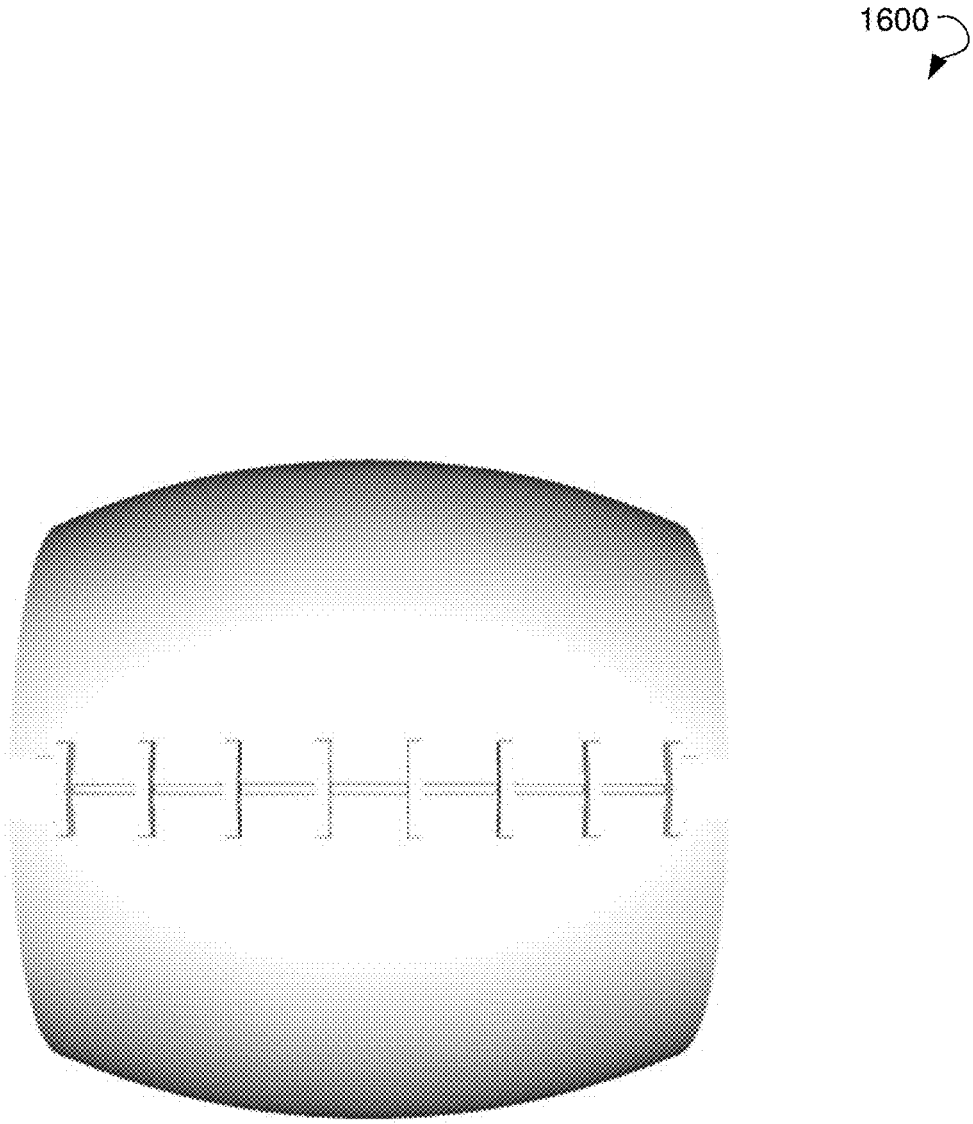
FIG. 19 is a top view of a cover with laces visible according to various embodiments of the present technology.

FIG. 19 is a top view of the cover 1600 with laces visible according to various embodiments of the present technology.

Figure 20:
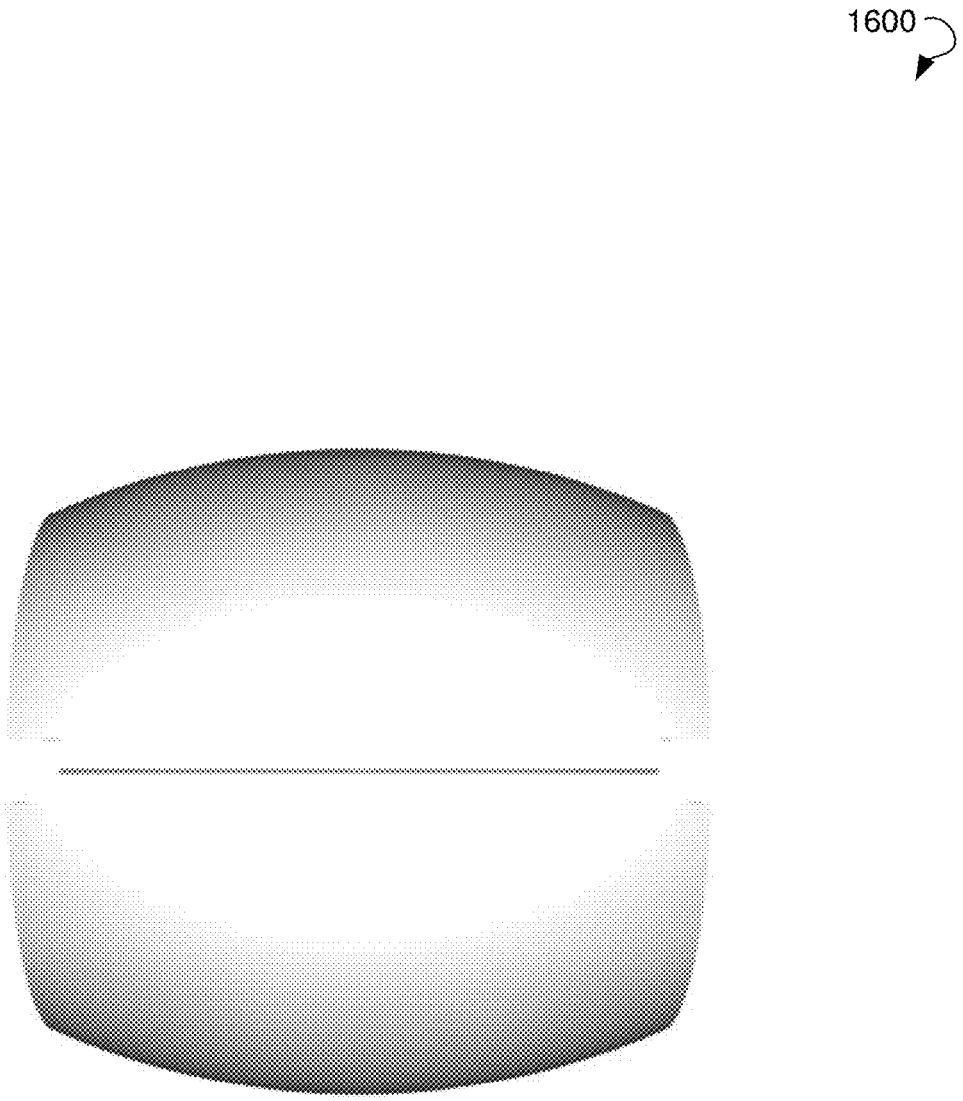
FIG. 20 is a bottom view of a cover according to various embodiments of the present technology.

FIG. 20 is a bottom view of the cover 1600 according to various embodiments of the present technology.

Figure 21:
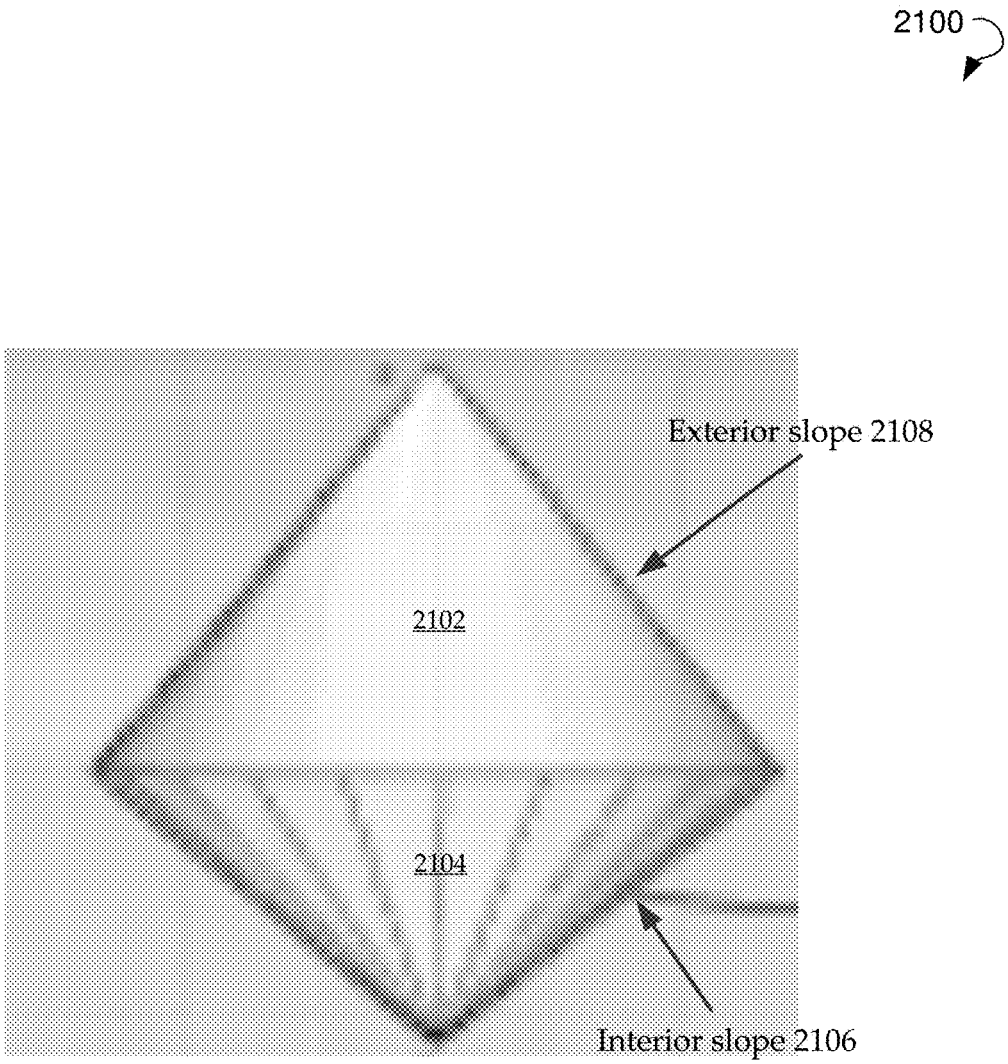
FIG. 21 is a side view of a bicone showing an exterior cone and an interior cone with the interior cone having a steeper interior slope than an exterior slope of the exterior cone according to various embodiments of the present technology.

FIG. 21 is a side view of an exemplary bicone 2100 (e.g., first bicone 112 and second bicone 118) showing an exterior cone 2102 (e.g., exterior first cone 114 and exterior second cone 120) and an interior cone 2104 (e.g., interior first cone 116 and interior second cone 122) with the interior cone 2104 having an interior slope 2106 greater than an exterior slope 2108 of the exterior cone 2102 according to various embodiments of the present technology. FIG. 21 further illustrates an interior slant height of the interior cone 2104 is greater than an exterior slant height of the exterior cone 2102 resulting in the interior slope 2106 of the interior cone 2104 greater than the exterior slope 2108 of the exterior cone 2102.

While this technology is susceptible of embodiment in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A tubular projectile device, comprising:

a spheroid frame having a long axis and a short axis, the spheroid frame comprising:

a plurality of lateral support members along the long axis of the spheroid frame;

a dorsal support member along the long axis of the spheroid frame; and a ventral support member along the long axis of the spheroid frame;

a tubular medial section coupled with the plurality of lateral support members, the dorsal support member, and the ventral support member;

a first bicone comprising an exterior first cone congruent with, and joined to, an interior first cone base-to-base, the first bicone being terminal along the long axis of the spheroid frame and being coupled with the plurality of lateral support members, the dorsal support member, and the ventral support member; and a second bicone comprising an exterior second cone congruent with, and joined to, an interior second cone base-to-base, the second bicone being terminal along the long axis of the spheroid frame and being coupled with the plurality of lateral support members, the dorsal support member, and the ventral support member.

2. The tubular projectile device of claim 1, further comprising a first opening from an exterior apex point of the exterior first cone to an interior apex point of the interior first cone, the first opening allowing airflow through the first bicone during flight of the tubular projectile device to improve aerodynamics of the tubular projectile device.

3. The tubular projectile device of claim 2, further comprising a second opening from an exterior apex point of the exterior second cone to an interior apex point of the interior second cone, the second opening allowing airflow through the second bicone during flight of the tubular projectile device to improve aerodynamics of the tubular projectile device during flight.

4. The tubular projectile device of claim 1, wherein an interior slant height of the interior first cone is greater than an exterior slant height of the exterior first cone resulting in an interior slope of the interior first cone being greater than an exterior slope of the exterior first cone.

5. The tubular projectile device of claim 1, wherein an interior slant height of the interior second cone is greater than an exterior slant height of the exterior second cone resulting in an interior slope of the interior second cone being greater than an exterior slope of the exterior second cone.

6. The tubular projectile device of claim 1, wherein the first bicone and the second bicone are hollow.

7. The tubular projectile device of claim 1, wherein the first bicone and the second bicone are solid.

8. The tubular projectile device of claim 1, wherein the first bicone and the second bicone include an activity tracking device to track flight metrics of the tubular projectile device.

9. The tubular projectile device of claim 1, wherein the spheroid frame including the plurality of lateral support members, the dorsal support member, and the ventral support member is a solid-state weld.

10. The tubular projectile device of claim 1, wherein the spheroid frame further comprises a cross shaped support member, the cross shaped support member being a first support member perpendicular to a second support member, the cross shaped support member being located in an interior of the tubular medial section.

11. The tubular projectile device of claim 1, wherein the spheroid frame comprises polyethylene.

12. The tubular projectile device of claim 1, wherein the tubular medial section is a straight tubular shape.

13. The tubular projectile device of claim 1, wherein the tubular medial section is a curved tubular shape.

14. The tubular projectile device of claim 1, further comprising a padding layer surrounding the tubular medial section.

15. The tubular projectile device of claim 14, further comprising a skin layer on top of the padding layer surrounding the tubular medial section.

16. The tubular projectile device of claim 1, further comprising a plurality of laces coupled to the ventral support member.

17. A tubular projectile device, comprising:

a spheroid frame having a long axis and a short axis, the spheroid frame comprising:

a plurality of lateral support members along the long axis of the spheroid frame;

a dorsal support member along the long axis of the spheroid frame; and a ventral support member along the long axis of the spheroid frame;

a tubular medial section coupled with the plurality of lateral support members, the dorsal support member, and the ventral support member;

a first bicone comprising an exterior first cone congruent with an interior first cone, the first bicone being anterior along the long axis of the spheroid frame and being coupled with the plurality of lateral support members, the dorsal support member, and the ventral support member;

an anterior airflow space between the first bicone and the tubular medial section, the anterior airflow space allowing air to flow into the tubular medial section during flight of the tubular projectile device;

a second bicone comprising an exterior second cone congruent with an interior second cone, the second bicone being posterior along the long axis of the spheroid frame and being coupled with the plurality of lateral support members, the dorsal support member, and the ventral support member; and a posterior airflow space between the second bicone and the tubular medial section, the posterior airflow space allowing air to flow out of the tubular medial section during flight of the tubular projectile device.

18. The tubular projectile device of claim 17, wherein the anterior airflow space is smaller than the posterior airflow space resulting in improved flight dynamics of the tubular projectile device.

19. The tubular projectile device of claim 17, wherein the anterior airflow space is the same size as the posterior airflow space resulting in the tubular projectile device being capable of bidirectional flight.

20. A football, comprising:

a spheroid frame having a long axis and a short axis, the spheroid frame comprising:

a plurality of lateral support members along the long axis of the spheroid frame;

a dorsal support member along the long axis of the spheroid frame; and a ventral support member along the long axis of the spheroid frame;

a tubular medial section coupled with the plurality of lateral support members, the dorsal support member, and the ventral support member;

a first bicone comprising an exterior first cone congruent with an interior first cone, the first bicone being anterior along the long axis of the spheroid frame and being coupled with the plurality of lateral support members, the dorsal support member, and the ventral support member;

an anterior airflow space between the first bicone and the tubular medial section, the anterior airflow space allowing air to flow into the tubular medial section during flight of the football;

a second bicone comprising an exterior second cone congruent with an interior second cone, the second bicone being posterior along the long axis of the spheroid frame and being coupled with the plurality of lateral support members, the dorsal support member, and the ventral support member; and an posterior airflow space between the second bicone and the tubular medial section, the posterior airflow space allowing air to flow out of the tubular medial section during flight of the football;

wherein the anterior airflow space is smaller than the posterior airflow space resulting in improved flight dynamics of the football.

* * * * *